US005947776A

United States Patent [19]

Epe

[11] Patent Number: 5,947,776

[45] Date of Patent: Sep. 7, 1999

[54] ELECTRIC PLUG-IN CONNECTOR

[75] Inventor: Peter Epe, Lennestadt, Germany

[73] Assignee: Leopold Kostal GmbH & Co. KG, Ludenscheid, Germany

[21] Appl. No.: 08/952,607

[22] PCT Filed: May 14, 1996

[86] PCT No.: PCT/EP96/02059

§ 371 Date: Mar. 16, 1998

§ 102(e) Date: Mar. 16, 1998

[87] PCT Pub. No.: WO96/37014

PCT Pub. Date: Nov. 21, 1996

[30] Foreign Application Priority Data

May 20, 1995 [DE] Germany ..... 195 18 567

[51] Int. Cl.[6] ..... H01R 13/514

[52] U.S. Cl. ..... 439/752; 439/595

[58] Field of Search ..... 439/595, 682, 439/685, 689, 751, 752, 752.5, 680, 681

[56] References Cited

U.S. PATENT DOCUMENTS

| | | | |
|---|---|---|---|
| 4,702,712 | 10/1987 | Ghorbani et al. | 439/596 |
| 4,781,626 | 11/1988 | Lazarchik | 439/680 |
| 4,986,758 | 1/1991 | Wakata . | |
| 5,199,900 | 4/1993 | Hayes, Sr. | 439/557 |
| 5,421,734 | 6/1995 | MacWilliams | 439/59 |
| 5,468,162 | 11/1995 | Oda | 439/752 |
| 5,554,052 | 9/1996 | Saijo et al. | 439/595 |
| 5,575,683 | 11/1996 | Saito et al. . | |
| 5,692,929 | 12/1997 | Hoffmann . | |

FOREIGN PATENT DOCUMENTS

| | | |
|---|---|---|
| A0330436 | 8/1989 | European Pat. Off. . |
| A0617484 | 9/1994 | European Pat. Off. . |
| A4420546 | 12/1994 | Germany . |
| A2280795 | 2/1995 | United Kingdom . |

*Primary Examiner*—Lincoln Donovan
*Attorney, Agent, or Firm*—Brooks & Kushman P.C.

[57] ABSTRACT

An electric connector includes a housing having chambers for receiving contact elements of a mating connector. A locking element is on a plug side of the housing to be connected to a mating connector. The locking element is shiftable between unlocked and locked positions to release and secure the contact elements in the chambers. The locking element is held in the unlocked position by interlocking engaging elements of the locking element and the housing. The locking element has locking pins extending radially into the frame opening. The engaging elements hold and guide the locking element in a slidable manner such that the locking element can be moved from the unlocked position to latch into the locked position by a sliding motion. The locking pins grip through openings in the chambers when the locking element is in the locked position and rest directly against the contact elements inserted into the chambers. At least one coding element is associated with the locking element which permits connection of the connector only with a compatible mating connector. A flexible deformable stop pin is provided on the locking element in the direct proximity of the locking pins. The stop pin latches into an opening of the housing when the locking element is in the locked position.

10 Claims, 2 Drawing Sheets

(UNLOCKED)

(LOCKED)

ELECTRIC PLUG-IN CONNECTOR

Figure 1:
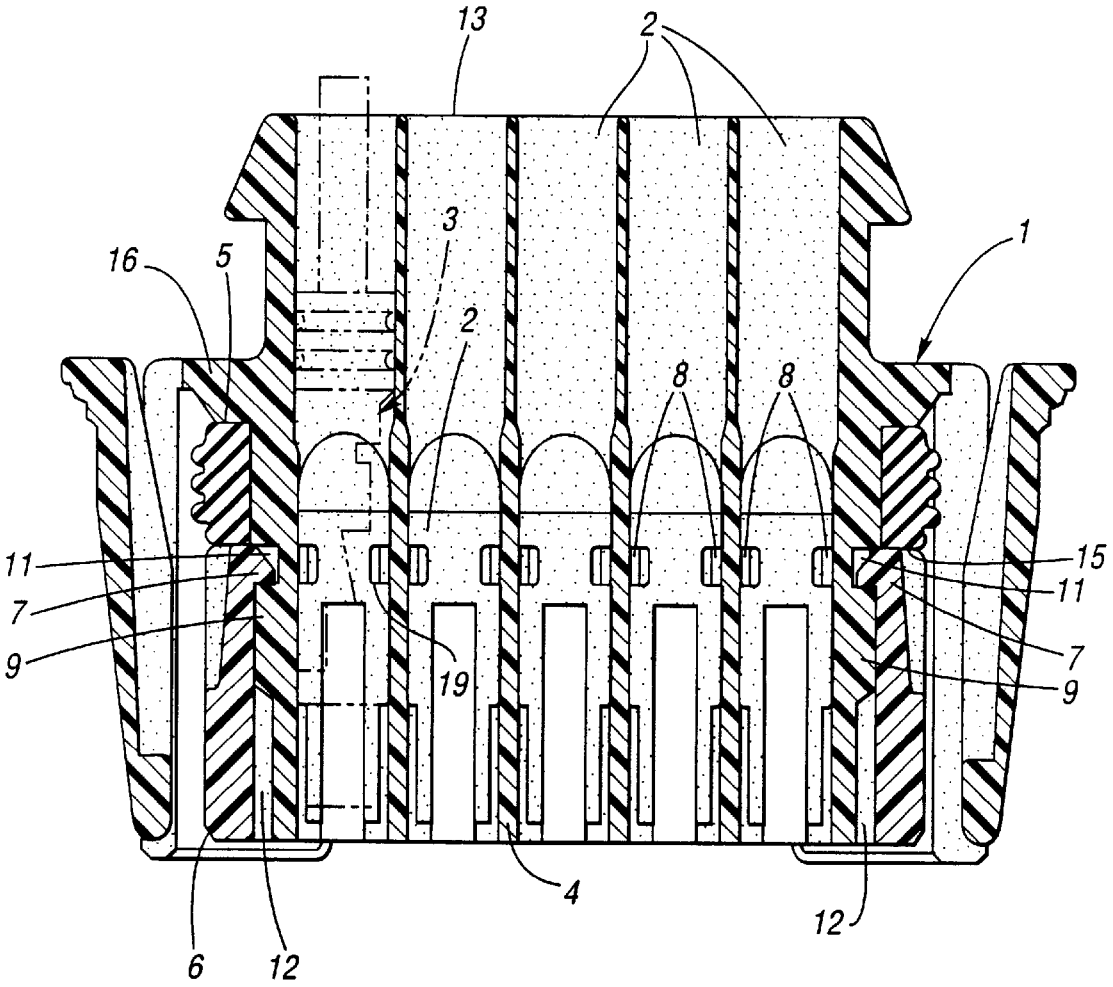

This invention is based on an electric plug-in connector element conceived in accordance with the preamble of the main claim.

A plug-in connector element of this type attached to an electric lead is intended primarily to establish an electro-conductive, detachable connection to an appertaining electrical unit by way of a plug-in connector mating element attached to a further electric lead.

An electric plug-in connector element is known in the art in DE 44 26 624 A1 in which the locking element is fixed to the insulating housing (1) in such a way that it can be slid between an unlocked and a locked position and moved into its unlocked position by effecting a sliding motion from the plug-in side parallel to the plug-in direction. By way of interlocking engaging elements moulded onto the locking element and the insulating housing the locking element is temporarily retained in the unlocked position on the insulating housing. In the unlocked position it is a simple matter to equip the chambers of the insulating housing with plug-in contact elements or remove the plug-in contact elements from their chambers. In order to transfer the locking element from the unlocked position to the locked position it must be pushed further onto the plug-in area of the insulating housing, parallel to the plug-in direction. This measure keeps the electric plug-in contact elements interlocked in their chambers. With a plug-in connector element developed in this way the coinciding movement sequence to achieve the unlocked and the locked position can however cause the locking element to move involuntarily or unintentionally to its locked position even though the plug-in contact elements still have to be installed, or their assembly completed. If this is not noticed in time, a troublesome and time-consuming unlocking process and a new assembly procedure are necessary to carry out correct assembly. For the same reason it is also possible for a plug-in connector element which has not been properly assembled to be coupled to a plug-in connector mating element, even though the locking element was originally in its unlocked position during the coupling procedure. This is due to the fact that the locking element can be moved unnoticed from its unlocked position into its locked position during the coupling process.

The present invention is therefore based on the task of creating a plug-in connector element with a locking element which can only be moved from its unlocked position to its locked position by effecting a deliberately controlled motion sequence; which is locked very securely in that position and which is designed as a one-piece construction in such a way that the plug-in connector element can only be coupled with appropriately designed plug-in contact mating elements intended expressly for such a connection.

In accordance with this invention the task is solved by the features detailed in the characterizing part of the main claim. The advantage of such a construction is that it is possible to effect various discreet assignments to different plug-in contact mating elements solely by replacing the locking element, consequently making it feasible to realize a system of plug-in contact elements using simple means.

Further markedly advantageous constructions of the subject of this invention are detailed in the subclaims. The invention is described in detail on the basis of an exemplary version shown in the drawing and demonstrated in FIG. 1 as a cross section of a plug-in connector element FIG. 2 as a front view of a plug-in connector element acc. to FIG. 1 with a locking element in the unlocked position FIG. 3 as a front view of a plug-in connector element acc. to FIG. 1, with a locking element in the locked position As is evident from the drawing, such a plug-in connector element consists essentially of an insulating housing 1 of which the chambers 2 are designed as receptacles for plug-in contact elements 3, and whose plug-in area 4 holds a fixed sealing element 5 and a locking element 6 which is shifted between an unlocked and a locked position.

The insulating housing 1 is fitted with five through chambers 2 arranged side by side, whereby each of the five chambers 2 is equipped to accommodate a plug-in contact element 3. As is evident from FIG. 1 and FIG. 2, the locking element 6 made of synthetic material is basically shaped as an oval frame. On each of the two semi-circular wall areas of the locking element 6 there is a engaging element moulded on as a detent arm 7. The two flexibly outswinging detent arms 7 are intended to clip fasten the locking element 6 onto the insulating housing 1 and therefore run parallel to the plug-in direction of the plug-in connector element. To the greatest possible extent, the two detent arms 7 constitute integral components of the locking element 6. Divergent from the oval form, several locking pins 8 are moulded onto one of the two longitudinal walls of the locking element 6. For this reason the locking pins 8 for fastening the plug-in contact elements 3 lie at right angles to the plug-in direction and project prong-like into the frame opening of the locking element 6.

Figure 2:
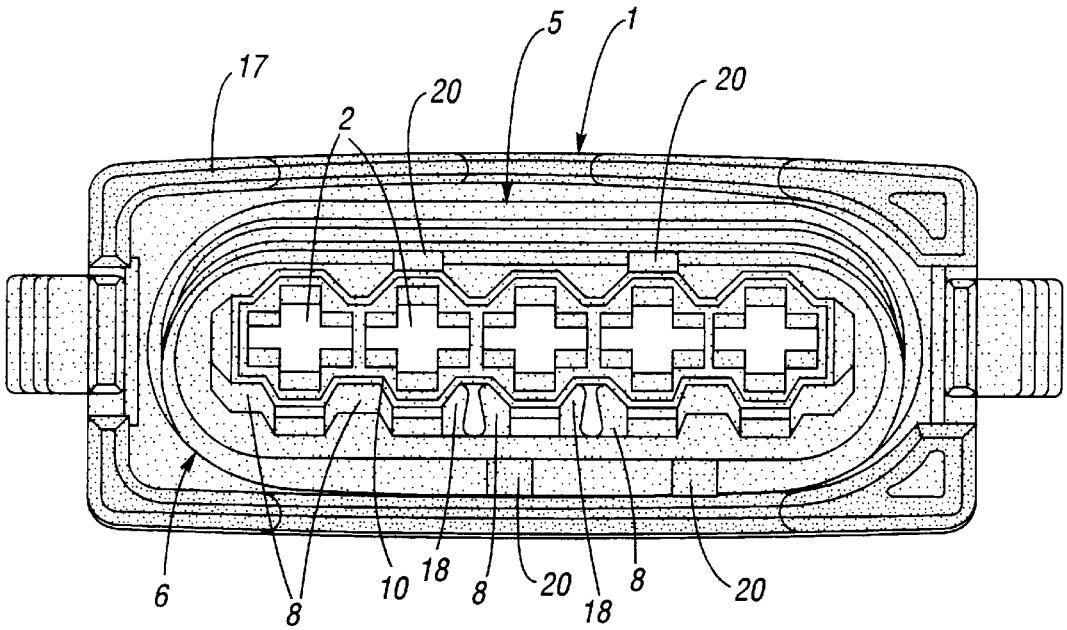
Figure 3:
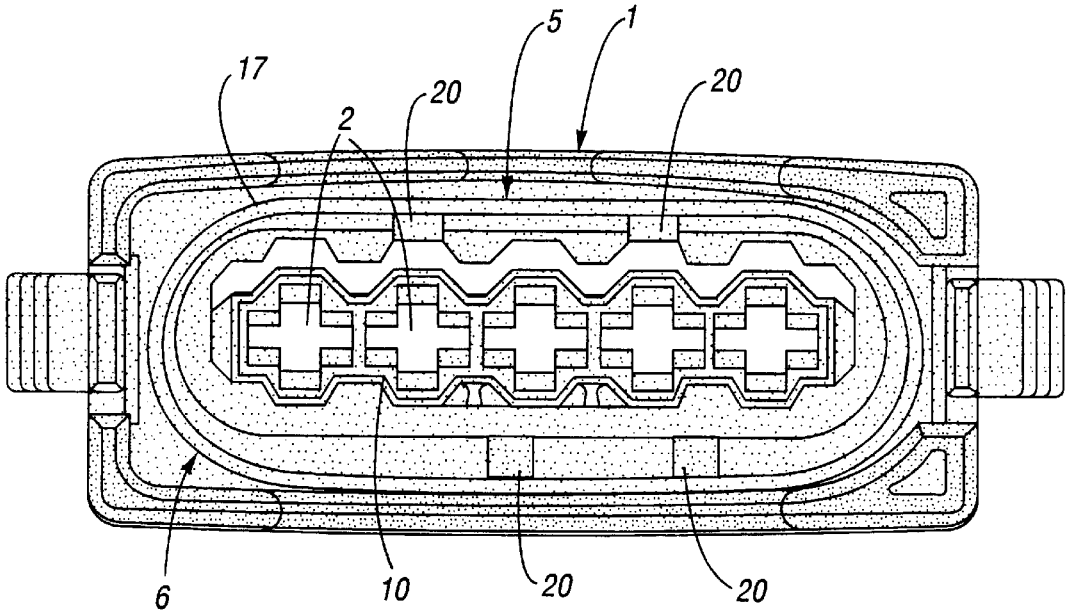

In order to reach the unlocked position as shown in FIG. 2, the locking element 6 is pushed from the plug-in side onto the plug-in area 4 of the insulating housing 1 parallel to the plug-in direction—in a similar manner to a plug-in connector mating element. During this sliding process the two detent arms 7 come to bear on the two small faces 9 and the locking pins 8 on the pertaining longitudinal wall 10 of the plug-in area 4. To attain its unlocked position the locking element 6 is pushed onto the plug-in area 4 of the insulating housing 1 until each of the two detent arms 7 grip into a detenting slot 11 constituting the engaging element of the plug-in area 4. The two detenting slots 11 lie at right angles to the plug-in direction, ensuring secure retention on the one hand and making it feasible to slide the locking element 6 at right angles to the plug-in direction—necessary to attain the locked position—on the other hand. In order to make the process of sliding the locking element 6 onto the plastic insulating housing 1 effective and exceptionally smooth, two inserting grooves 12 with lead-in ramps are moulded into the plug-in area 4 from the plug-in side. The inserting grooves 12 are intended to guide the two flexibly outswinging detent arms 7 during the sliding process. Due to the locking pins 8 coming to bear with their free ends on the pertaining longitudinal wall 10 of the plug-in area 4, the locking element 6 takes up a misaligned position in relation to the plug-in side of the insulating housing 1. This makes it impossible to join the plug-in connector element with its coordinating plug-in connector mating element, since the locking element 6 is in its unlocked position.

As long as the locking element 6 is in the above described unlocked position the plug-in contact elements 3 can be inserted into the chambers 2 of the insulating housing 1 from the rear side 13 which faces away from the plug-in side. Since the locking pins 8 do not grip into the chambers 2 when the locking element 6 is in the unlocked position, it is possible to insert the plug-in contact elements 3 without hindrance. Once the plug-in contact elements 3 have been completely installed in their appropriate chambers 2, flexibly outswinging retention arms 14 which are formed on the plug-in contact elements 3 engage in retention heels in the chamber walls. As a result, the plug-in contact elements 3 are held securely in place in their chambers 2. Should it become necessary to remove the plug-in contact elements 3 from their chambers 2, this can also be effected in the unlocked position of the locking element 6 without difficulty by unfastening the retention arms 14 from their respective retention heels beforehand. This can be effected easily, for instance by implementing a universal releasing tool.

As is further evident from FIG. 1 and FIG. 2, the plug-in area 4 of the insulating housing 1 features a sealing element 5. Prior to attaching the locking element 6 to the insulating housing 1 the sealing element 5 is also pushed onto the plug-in area 4 of the insulating housing 1 from the plug-in side. The sealing element 5, which is also of an essentially oval, framelike shape and made of flexibly deformable synthetic material, is held securely in position between the edge 15 of the locking element 6 facing away from the plug-in side and a resting bead 16 moulded onto the insulating housing 1. The sealing element 5 consequently comes to bear on the edge 15 of the locking element 6 with its ring surface which faces the plug-in side, and on the resting bead 16 with its other ring surface which faces the rear side 13. This ensures the safe and accurate retention of the sealing element 5, even after coupling and disconnecting the plug-in connector element and a plug-in connector mating element numerous times. At the same time, the resting bead 16 constitutes the basis of a collar-shaped expansion 17 of the insulating housing 1. The walls of this expansion 17, which lie parallel to the plug-in direction, loosely encompass the plug-in area 4 of the insulating housing 1 and the locking element 6. By way of this arrangement the plug-in area of the plug-in connector mating element is sealed against moisture penetration taken up by the plug-in area 4 of the plug-in contact element. The plug-in side of the insulating housing 1, the front face of the collar-shaped expansion 17 and the front face of the locking element 6 form the plug-in face of the plug-in connector element, whereby the locking element 6 represents a major part of the plug-in face.

In order to move the locking element 6 into its locked position, as demonstrated in particular in FIG. 2, the locking element 6 is shifted at right angles to the plug-in direction in a sliding motion from its unlocked position. During the deliberately effected shifting motion the two detent arms 7 of the locking element 6 slide with their stop surfaces along the corresponding groove walls of the two detenting slots 11. In this way the locking element 6 remains securely retained on the insulating housing 1 even during the shifting motion. Two of the locking pins 8 are equipped with stop nibs 18 and are of a flexibly deformable design. Since each of these two locking pins 8 grips into an opening of the chambers 2 in a latching manner, the locking elements 6 is secured in a latching manner in the locked position on the plug-in area 4. In the locked position the locking pins 8 grip through the openings in the chambers 2 and in doing this come directly to bear on shoulder-like areas 19 of the plug-in contact elements 3 which have been inserted into the chambers 2. The openings are arranged in such a way and the locking pins 8 are distributed on the locking element 6 in such a manner that two locking pins 8 are assigned to one plug-in contact element 3 or lock the same. By way of the interlocking fastening of the plug-in contact elements 3 it is not possible to simply remove the same from the chambers 2 unless the fastening has first been deliberately released.

Only at this point, when the locking element 6 is in its locked position as a result of effecting a deliberate sliding motion at right angles to the plug-in direction, can the plug-in connector element be coupled with its plug-in connector mating element. This is due to the fact that the alignment of the locking element 6 in relation to the plug-in side of the plug-in area 4 only matches in the locked position. To ensure that connection can only be carried out between plug-in connector elements and plug-in connector mating elements which are really intended for such a connection, the locking element 6 is equipped with several coding elements 20. The coding elements 20 are designed as recesses and moulded into the outer walls of the locking element 6. For this reason, the plug-in connector element can only be connected with a plug-in connector mating element which is equipped with appropriately shaped and located coding elements in the form of fins.

I claim:

1. An electric plug-in connector comprising:

a housing (1) having a plurality of chambers (2) arranged in at least one row for receiving a respective one of a plurality of contact elements (3) of a mating connector;

a shiftable locking element (6) having a generally oval, frame-like shape provided on a plug side of the housing to be connected to the mating connector, the locking element (6) being shiftable between unlocked and locked positions to release and secure the contact elements (3) in the chambers (2), wherein the locking element (6) is shiftable to the unlocked position by a sliding motion carried out on the plug side generally parallel to an axial, plug-in direction and held in the unlocked position by interlocking engaging elements (7,11) of locking element (6) and housing (1);

said locking element (6) having locking pins (8) extending radially to the axial, plug-in direction into the frame opening, the engaging elements holding and guiding the locking element (6) in a slidable manner in plug-in area (4) of housing (1) such that the locking element (6) can be moved from the unlocked position to latch into the locked position by a sliding motion carried out in a direction generally normal to the axial, plug-in direction, wherein the locking pins (8) of locking element (6) grip through openings in the chambers (2) when the locking element (6) is in the locked position and come to rest against contact elements (3) inserted into the chambers;

at least one coding element (20) associated with the locking element (6) which permits connection of the connector only with a compatible mating connector; and a flexible deformable stop pin (18) provided on the locking element (6) in the direct proximity of the locking pins (8) which latches into an opening of the housing (1) when the locking element (6) is in the locked position.

2. The connector of claim 1 wherein:

the at least one coding element (20) is located on an outer wall of the locking element (6).

3. The connector of claim 2 wherein:

the at least one coding element (20) is a recess located on the outer wall of the locking element (6).

4. The connector of claim 2 wherein:

the at least one coding element (20) is a projection on the outer wall of the locking element (6).

5. The connector of claim 1 wherein:

the engaging elements of the locking element (6) include two integral, flexible outswinging detent arms (7) each of which grips into a detenting slot (11) in the plug-in area (4) and runs generally radially to the axial, plug-in direction.

6. The connector of claim 5 wherein:

the plug-in area (4) of housing (1) has an inserting groove (12) for each detent arm (7) running generally parallel to the axial, plug-in direction.

7. The connector of claim 1 wherein:

the stop pin (18) is arranged between two locking pins (8).

8. The connector of claim 1 wherein:

at least one of the locking pins (8) is flexibly deformable, whereby in the locked position of locking element (6) the stop pin (18) latches into an opening in the chambers (2) of the housing (1).

9. The connector of claim 1 wherein:

the locking element (6) is encompassed by a collar-shaped expansion (17) provided on the plug side of housing (1) as a receptacle for the plug-in area of the mating connector.

10. The connector of claim 1 wherein:

one of the ring surfaces of a sealing element (5) pertaining to the plug-in area (4) comes to bear in a supporting manner on the edge (15) of the locking element (6) facing away from the front face.

* * * * *